United States Patent [19]

Cramer

[11] 4,216,933

[45] Aug. 12, 1980

[54] PORTABLE SCAFFOLD SUPPORT BASE

[76] Inventor: Milton A. Cramer, Jr., 4608 Falcon St., Rockville, Md.

[21] Appl. No.: 17,975

[22] Filed: Mar. 6, 1979

[51] Int. Cl.[3] ..... F16M 11/26; E06C 5/04

[52] U.S. Cl. ..... 248/188.5; 108/51.1; 108/56.1; 182/63; 182/179; 248/346

[58] Field of Search ..... 108/51.1, 56.1, 53.3, 108/54.1, 55.1, 57.1; 182/63, 178, 179; 52/126; 248/188.5, 346

[56] References Cited

U.S. PATENT DOCUMENTS

| | | | |
|---|---|---|---|
| 2,598,730 | 6/1952 | Thompson et al. | 182/63 |
| 2,820,561 | 1/1958 | Meagher | 182/63 X |
| 3,063,667 | 11/1962 | Doty, Jr. et al. | 108/51.1 X |
| 3,071,204 | 1/1963 | Piltingsreed | 182/179 X |
| 3,302,751 | 2/1967 | Ahlberg | 182/179 X |
| 3,329,103 | 7/1967 | Cohen | 108/54.1 |
| 3,506,138 | 4/1970 | Travis | 108/56.1 X |
| 3,850,264 | 11/1974 | Salinas | 182/178 |
| 3,857,494 | 12/1974 | Giardini | 108/53.5 X |

FOREIGN PATENT DOCUMENTS

| | | | |
|---|---|---|---|
| 1406373 | 6/1965 | France | 182/178 |
| 2301443 | 9/1976 | France | 108/51.1 |
| 86077 | 6/1955 | Norway | 182/178 |

*Primary Examiner*—William E. Lyddane

*Attorney, Agent, or Firm*—Larson, Taylor and Hinds

[57] ABSTRACT

A portable scaffold support base is disclosed which can be transported from one use site to another by a fork lift or the like. When it is delivered to the use site, the base is oriented horizontal by adjusting vertical supporting legs which are initially located over the best available surface by an outrigger extending from the base.

5 Claims, 2 Drawing Figures

PORTABLE SCAFFOLD SUPPORT BASE

FIELD OF THE INVENTION

This invention relates generally to the field of scaffolds, and more particularly to portable ground supported scaffolds which are oriented horizontal by adjusting the supporting legs of the scaffold base.

BACKGROUND OF THE INVENTION

Scaffolds are used for a variety of purposes in building constructions and repairs, and particularly for plastering, painting and the like. Once erected, scaffolds are generally quite cumbersome and difficult to move without disassembly. One prior art device, as disclosed in U.S. Pat. No. 2,360,999 to Wyen, attempted to solve this problem by providing a scaffold on rollers. The assembled scaffold could be rolled from place to place and lifted off the rollers by means of jack screws when the scaffold is in the desired position. Unfortunately, this type of device could only be used on relatively flat and even surfaces and is totally unsuited for exterior building use.

The most common solution to the problem of scaffold mobility is to provide for an easily disassembled scaffold. For instance, in U.S. Pat. No. 650,900 to Knopfe, the scaffold is made of simple and interchangeable parts adapted to be quickly and accurately assembled and disassembled for transportation. In order to make the scaffold more versatile, the base beams which normally rest on the ground have adjusting shoes for uneven surfaces. Another scaffold which can be easily broken for transport or storage is disclosed in U.S. Pat. No. 3,071,204 to Piltingsreed. The scaffold disclosed in this patent also has adjustable legs as well as having a variable length.

Another limited solution to the problem of scaffold mobility is, instead, to provide an extension from the scaffold. For example, the scaffolds disclosed in U.S. Pat. No. 3,480,110 to Coleman and U.S. Pat. No. 3,850,264 to Salinas provide for a horizontal member extended from the main scaffold on which a second platform is constructed. Thus, instead of moving the scaffold, it can be easily extended instead. These scaffolds are also designed for easy disassembly and transport, and have adjustable support legs.

However, none of the foregoing prior art devices provide for the ready transportation of an assembled scaffold for both interior and exterior use. In particular, except for the device disclosed in the Wyen patent, none of the foregoing prior art is designed for transportation while erected. This is particularly a problem when scaffolds with multiple levels must be moved, as each level must be disassembled and then reassembled at the new use site.

In addition, none of the foregoing prior art devices provide for support legs which are not only adjustable in height to level the scaffold, but which can be positioned at the best available surfaces. This is especially important where a scaffold must be erected in an area with an uneven surface or a surface with raised obstructions or depressions.

SUMMARY OF THE INVENTION

The present invention provides a novel apparatus for providing the base of a readily transportable scaffold. The present invention also provides a scaffold support base which is oriented horizontal by adjustable supporting legs. Additionally, the present invention provides a means to position each supporting leg on the best available surface.

An object of the present invention is to provide a scaffold base which can be easily transported to another use site by a fork lift or the like. Thus, once erected, the scaffold need not be disassembled in order to move it.

It is a further object of the present invention to provide a scaffold base which can be used on an uneven surface or on a surface with raised obstructions, depressions or unusable areas. Therefore, specially designed scaffolds or supports are unnecessary, as the scaffold base of the present invention can be utilized in these areas.

It is a feature of the present invention to provide a rigid rectangular scaffold with cross bars which forms a rugged and sturdy scaffold base. In addition, it is a further feature of the present invention to have the cross bars formed of tubular members which are positioned to be engaged by a fork lift or the like. Thus, the scaffold base and hence an erected scaffold thereon can be easily moved about by a fork lift.

It is a further feature of the present invention to provide for adjustable support legs to support the scaffold base. These support legs are adjustable vertically in order to orient the scaffold base horizontal. Additionaly, these support legs can be positioned horizontally away from the scaffold support base in cases where a suitable support surface is not available directly beneath the scaffold support base.

Other features, objects and advantages of the present invention are stated in or are apparent from the detailed description of the presently preferred embodiments found hereinbelow.

DETAILED DESCRIPTION OF THE PREFERRED EMBODIMENTS

Figure 1:
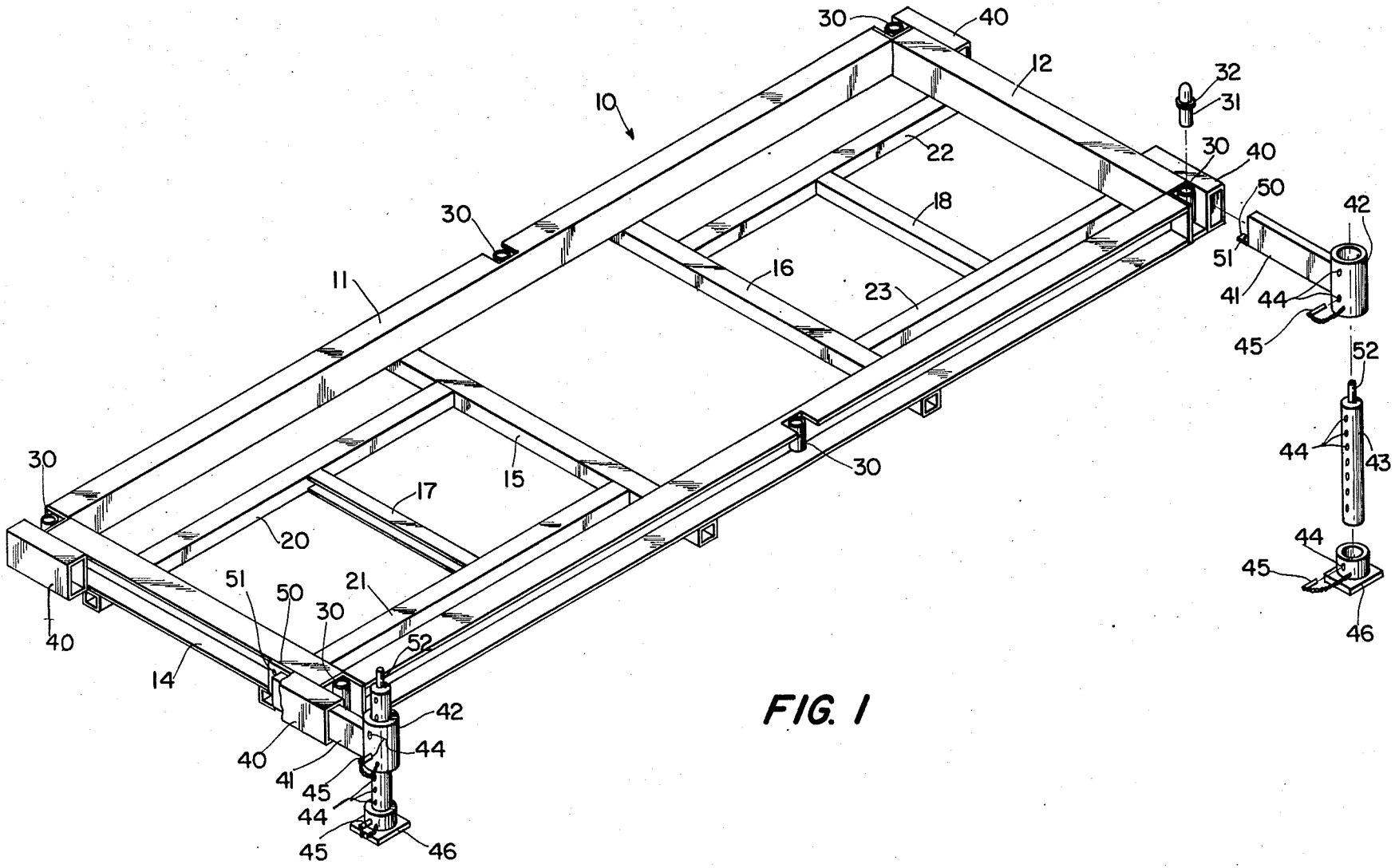
FIG. 1 is a perspective view of an embodiment of a scaffold support base having horizontally and vertically adjustable support legs.

With reference now to the drawings in which like numerals represent like elements throughout the several views, a presently preferred embodiment of the present invention is depicted in FIG. 1 and shows a standard sized 14' portable scaffold support base. The scaffold support base comprises a rectangular frame 10 formed by steel channelbeams 11, 12, 13 and 14 which are welded together at their intersections. Reinforcing rectangular frame 10 is a pair of cross bars 15 and 16 made of rectangular steel tubes. Cross bars 15 and 16 are parallel to each other and to beams 12 and 14 of rectangular frame 10. Equally spaced from the midpoints of beams 11 and 13, cross bars 15 and 16 are welded on the bottom flanges of beams 11 and 13. The distance between cross bars 15 and 16 corresponds to the distance between the fingers of a fork lift or the like.

In order to provide for an exceptionally rugged and sturdy rectangular frame 10, pairs of tubular reinforcing bars 20, 21, 22 and 23 are provided. One pair of reinforcing bars 20 and 21 is welded to the bottom flange of beam 14 and to the side of cross bar 15 while the other pair of reinforcing bars 22 and 23 are similarly attached to beam 12 and cross bar 16. Like cross bars 15 and 16, reinforcing bars 20, 21, 22 and 23 are also made of rectangular steel tubes. Similar to cross bars 15 and 16, the pairs of reinforcing bars 20, 21, 22 and 23 are parallel to each other and to beams 11 and 13, and equally spaced from the midpoints of beams 12 and 14 with the distance between each pair of reinforcing bars the same as the distance between cross bars 15 and 16. For maximum strength and ruggedness, two channel irons 17 and 18 are rigidly welded, respectively, to the tops of reinforcing cross bar pairs 20 and 21 or 22 and 23.

Located at the four corners of rectangular frame 10 and at the midpoint of beams 11 and 13, are tubular cylinders 30. Each cylinder 30 is welded to the inside vertical wall of respective beams 11, 12, 13 and 14 so that the longitudinal axis of each cylinder 30 is vertical. A portion of the top wall of beams 11, 12, 13 and 14 is cut away so that a standard receiving plug 31 with a raised shoulder 32 can be inserted into cylinder 30. Only one of the six such standard receiving plugs 31 which are used with this embodiment is shown in the drawing. Receiving plug 31 rests inside of cylinder 30 on shoulder 32. The upstanding portion of plug 31 receives the hollow legs of tubular scaffold structures which are well known in the art and will not be described further.

Also located at the corners of rectangular frame 10 are elongate outrigger collars 40. Each outrigger collar 40 is made from four steel plates welded together to form a rectangular passage through outrigger collar 40. One side of each outrigger collar 40 is welded either to beam 12 or 14 so that the longitudinal axis of outrigger collar 40 is parallel to beams 12 and 14. Slidably received in each outrigger collar 40 is an outrigger 41.

Welded on the end of each outrigger 41 is an elongate hollow sleeve 42 with its longitudinal axis vertically disposed. Each sleeve 42 telescopically receives a vertical support leg 43. Both sleeves 42 and support legs 43 have a plurality of bores 44 extending through them horizontally. A pin 45 is inserted through the bores 44 in sleeve 42 and support 43 to lock them together. Another pin 45 also locks a detachable foot 46 with a bore 44 therethrough on the bottom end of support leg 43. Each pin 45 is welded to a separate chain 47 at one end, and the other end of each chain is then welded to either sleeve 42 or foot 46. On the end of outrigger 41 opposite from hollow sleeve 42, a support plate 50 is welded. Support plate 50 can be oriented either horizontally or vertically on the end of sleeve 42. In each support plate 50, a hole 51 is used to receive a bolt which acts as a stop and prevents outrigger 41 from sliding out of outrigger collar 40.

In operation, the portable scaffold support base is used in the following manner. A fork lift or the like is used to engage cross bars 15 and 16, or reinforcing bar pairs 20 and 21 or 22 and 23. The fork lift then lifts and transports the scaffold support base to the desired use site. At the desired use site, each support leg 43 is first positioned over the best available supporting surface. Then, with foot 46 attached, each support leg 42 is adjusted in each respective sleeve 42 until rectangular frame 10 is level or horizontally oriented. The fork lift is then removed and suitable tubular scaffold structures are placed on receiving plugs 31 to form the scaffold. The scaffold itself may extend to several tiers. When completed, the scaffold rests on a sturdy and level scaffold support base. Should it be desired to move the entire scaffold, base and all, this can be done without disassembly. A fork lift is again used to lift and carry the scaffold support base and the rest of the scaffold by means of the cross bars 15 and 16 or reinforcing bar pairs 20 and 21 or 22 and 23. At the new use site, each support leg 43 is again positioned and adjusted to best support and level the scaffold support base and attached structure. The fork lift is then removed and the scaffold structure is again ready for use.

Figure 2:
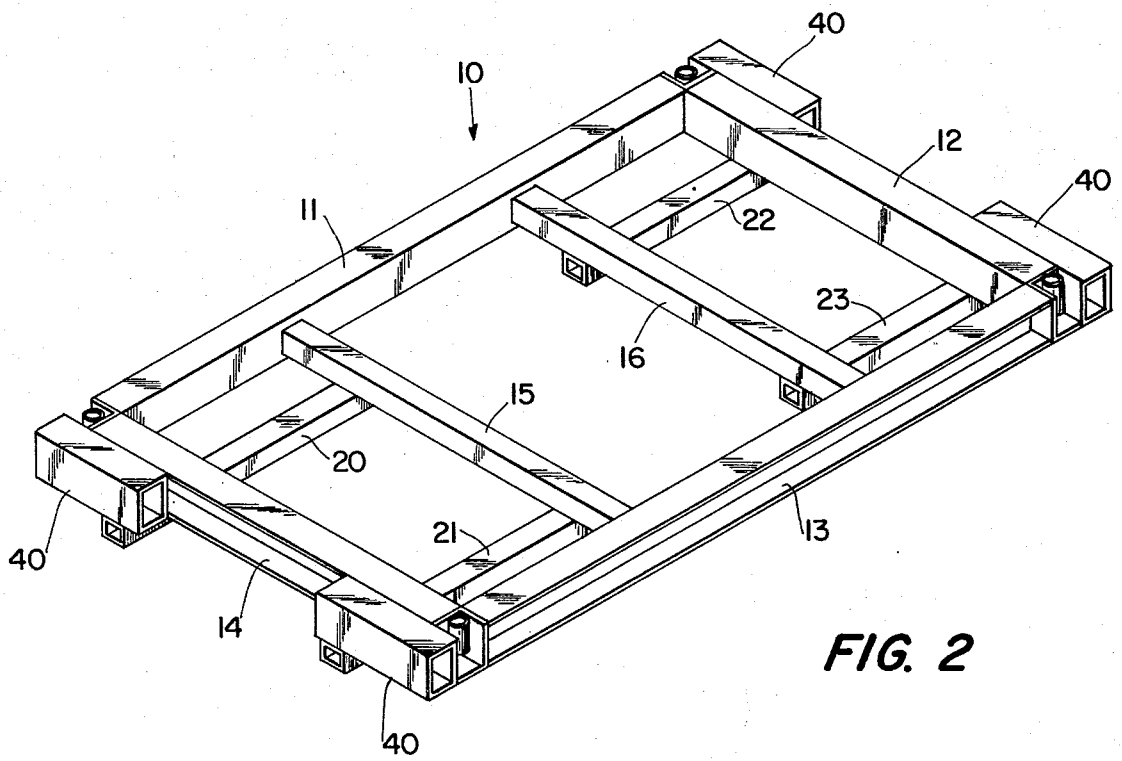
FIG. 2 is a perspective view of a smaller embodiment of a scaffold support base with the horizontally and vertically adjustable support legs omitted.

The embodiment of the invention depicted in FIG. 2 shows a similar portable scaffold support base which is a standard 7' length. As the same outrigger 41 and support leg structure shown in FIG. 1 is used with this embodiment, these elements are not shown in this drawing. Due to the shorter length of this embodiment, reinforcing bars 20, 21, 22 and 23 extend to a position where their outside ends are flush with the outside plate forming outrigger collars 40 and cross bars 15 and 16 are welded to the inside vertical walls of beams 11 and 13. Reinforcing bars 20, 21, 23 and 23 are also welded to respective outrigger collars 40 and to the bottom wall of cross bar 15 or 16. Thus, the fingers of a fork lift engage reinforcing bars 20, 21, 22 and 23 at one end below outrigger collar 40. And if fingers which are longer than reinforcing bars 20, 21, 22 and 23 are used, those fingers can extend out of the other end of reinforcing bars 20, 21, 22 and 23. Otherwise this embodiment is the same as the previously described embodiment and is used just like the previously described embodiment.

Other alternative embodiments of the invention should be apparent to those of ordinary skill in the art. For instance, receiving plug 31 could be omitted and the legs of a standard scaffold structure could be positioned directly in cylinders 30 to rest on the bottom flange of each beam 12 or 14. Also, to give the scaffold base extra mobility a detachable wheel could be used in place of each detachable foot 46 or support leg 43 could be inverted and wheels attached to a mounting peg 52. It should also be noted that outriggers 41 are reversible in outrigger collars 40 when the bolts are removed from hole 51 in plate 50 in that they can be inserted in outrigger collar 40 so that sleeve 42 travels beside beam 12 or 14 rather than away from beam 12 or 14. In this position, either support leg 43 can be used to support the scaffold support base, or plate 50 on outrigger 41 can be positioned in a horizontal or vertical mortar joint to support the base.

Although the invention has been described in detail with respect to exemplary embodiments thereof, it will be understood by those of ordinary skill in the art that variations and modifications may be effected within the scope and spirit of the invention.

I claim:

1. A portable scaffold support base comprising, a rigid rectangular frame, a pair of tubular cross bars rigidly attached to said frame in parallel and spaced relation, said tubular cross bars being open at one end to receive a fork lift, tubular outrigger collars disposed at each corner of said frame, outrigger members slidable in said collars and adapted to be adjustable to form horizontally disposed extensions from said frame, vertically disposed sleeves mounted on the outer ends of said outrigger members, vertically disposed support legs slidably received in said sleeves, means for locking said support legs in selected position in said sleeves, and means for attaching a scaffold mounted on said frame, whereby said frame may be supported in a horizontal plane with said outrigger members extended horizontally selected distances and said support legs extended vertically selected distances to provide support on the best available surface.

2. A portable scaffold support base as claimed in claim 1, wherein said means to lock said support leg in said sleeve includes at least one bore through said sleeve;

a plurality of bores through said support leg; and a pin, which passes through said bore in said sleeve and one of said bores in said support leg.

3. A portable scaffold support base as claimed in claim 1, further comprising pairs of tubular reinforcing bars, each of said pair of tubular reinforcing bars being spaced apart and parallel to each other and rigidly attached at one end perpendicular to one of said pair of tubular cross bars and attached at the other end to said frame such that said scaffold support base is also transportable by a fork lift or the like which engages one of said pairs of tubular reinforcing bars.

4. A portable scaffold support base as claimed in claim 3, wherein said tubular cross bars and said tubular reinforcing bars are rectangular in cross-section.

5. A portable scaffold support base as claimed in claim 3, further comprising a detachable foot mounted on the lower end of each of said vertical support legs.

* * * * *